US011791072B2

(12) United States Patent
Watanabe et al.

(10) Patent No.: US 11,791,072 B2
(45) Date of Patent: Oct. 17, 2023

(54) LAMINATED VARISTOR

(71) Applicant: Panasonic Intellectual Property Management Co., Ltd., Osaka (JP)

(72) Inventors: Michiya Watanabe, Hokkaido (JP); Naoki Mutou, Hokkaido (JP); Ken Yanai, Hokkaido (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 21 days.

(21) Appl. No.: 17/632,827

(22) PCT Filed: Jul. 16, 2020

(86) PCT No.: PCT/JP2020/027610
§ 371 (c)(1),
(2) Date: Feb. 4, 2022

(87) PCT Pub. No.: WO2021/131115
PCT Pub. Date: Jul. 1, 2021

(65) Prior Publication Data

US 2022/0270791 A1 Aug. 25, 2022

(30) Foreign Application Priority Data

Dec. 26, 2019 (JP) ..... 2019-235386

(51) Int. Cl.
*H01C 7/18* (2006.01)
*H01C 7/102* (2006.01)
*H01C 7/112* (2006.01)

(52) U.S. Cl.
CPC ..... *H01C 7/18* (2013.01); *H01C 7/102* (2013.01); *H01C 7/112* (2013.01)

(58) Field of Classification Search
CPC ..... H01C 7/18; H01C 7/102; H01C 7/112
See application file for complete search history.

(56) References Cited

U.S. PATENT DOCUMENTS 5,034,709 A * 7/1991 Azumi ..... H01C 7/112 29/610.1
5,119,062 A * 6/1992 Nakamura ..... H01C 7/10 338/21

(Continued)

FOREIGN PATENT DOCUMENTS

JP 56-153706 11/1981
JP 2002-313665 10/2002

OTHER PUBLICATIONS

International Search Report of PCT application No. PCT/JP2020/027610 dated Sep. 29, 2020.

*Primary Examiner* — Kyung S Lee
(74) *Attorney, Agent, or Firm* — McDermott Will & Emery LLP

(57) ABSTRACT

A laminated varistor includes a varistor layer, a first internal electrode provided on an upper surface of the varistor layer, a second internal electrode provided on a lower surface of the varistor layer and facing the first internal electrode across the varistor layer in upward and downward directions, a first external electrode provided on a first side surface of the varistor layer and electrically connected to the first internal electrode, and a second external electrode provided on a second side surface of the varistor layer and electrically connected to the second internal electrode. The first internal electrode is extended from the first external electrode in a first extension direction. The first internal electrode includes first electrode strips arranged in a first arrangement direction perpendicular to the first extension direction and spaced apart from one another. This laminated varistor has improved surge-resistant characteristics.

13 Claims, 4 Drawing Sheets

(56) References Cited

U.S. PATENT DOCUMENTS

| | | | | |
|---|---|---|---|---|
| 5,159,300 | A * | 10/1992 | Nakamura | H03H 1/0007 338/21 |
| 5,172,299 | A | 12/1992 | Yamada et al. | |
| 7,911,317 | B2 * | 3/2011 | Tanaka | H01C 7/102 338/21 |
| 9,583,262 | B2 * | 2/2017 | Rinner | H01C 7/18 |

* cited by examiner

LAMINATED VARISTOR

CROSS-REFERENCE TO RELATED APPLICATIONS

This application is a U.S. national stage application of the PCT International Application No. PCT/JP2020/027610 filed on Jul. 16, 2020, which claims the benefit of foreign priority of Japanese patent application No. 2019-235386 filed on Dec. 26, 2019, the contents all of which are incorporated herein by reference.

TECHNICAL FIELD

The present invention relates to a laminated varistor configured to protect an electronic circuit from lightning surge and static electricity.

BACKGROUND ART

A semiconductor circuit is mounted on a high-speed communication network or an electronic control unit of an automobile. Upon being damaged by surge current due to lightning, static electricity, or the like, the semiconductor circuit may have some trouble in the Internet communication or automobile control. To protect the semiconductor circuit from surge current, a laminated varistor made mainly of ceramic material is used in various kinds of electronic circuits as an electronic circuit component.

However, upon having large surge current flow in, the varistor may have characteristics deteriorate due to heat generation. Therefore, a laminated varistor having higher surge resistance is required.

PTL 1 discloses a conventional laminated varistor including plural internal electrodes facing each other.

CITATION LIST

Patent Literature

PTL1: Japanese Patent Laid-Open Publication No. 56-153706

SUMMARY

A laminated varistor includes a varistor layer, a first internal electrode provided on an upper surface of the varistor layer, a second internal electrode provided on a lower surface of the varistor layer and facing the first internal electrode across the varistor layer in upward and downward directions, a first external electrode provided on a first side surface of the varistor layer and electrically connected to the first internal electrode, and a second external electrode provided on a second side surface of the varistor layer and electrically connected to the second internal electrode. The first internal electrode is extended from the first external electrode in a first extension direction. The first internal electrode includes first electrode strips arranged in a first arrangement direction perpendicular to the first extension direction and spaced apart from one another.

This laminated varistor has improved surge-resistant characteristics.

DESCRIPTION OF EMBODIMENT(S)

Figure 1:
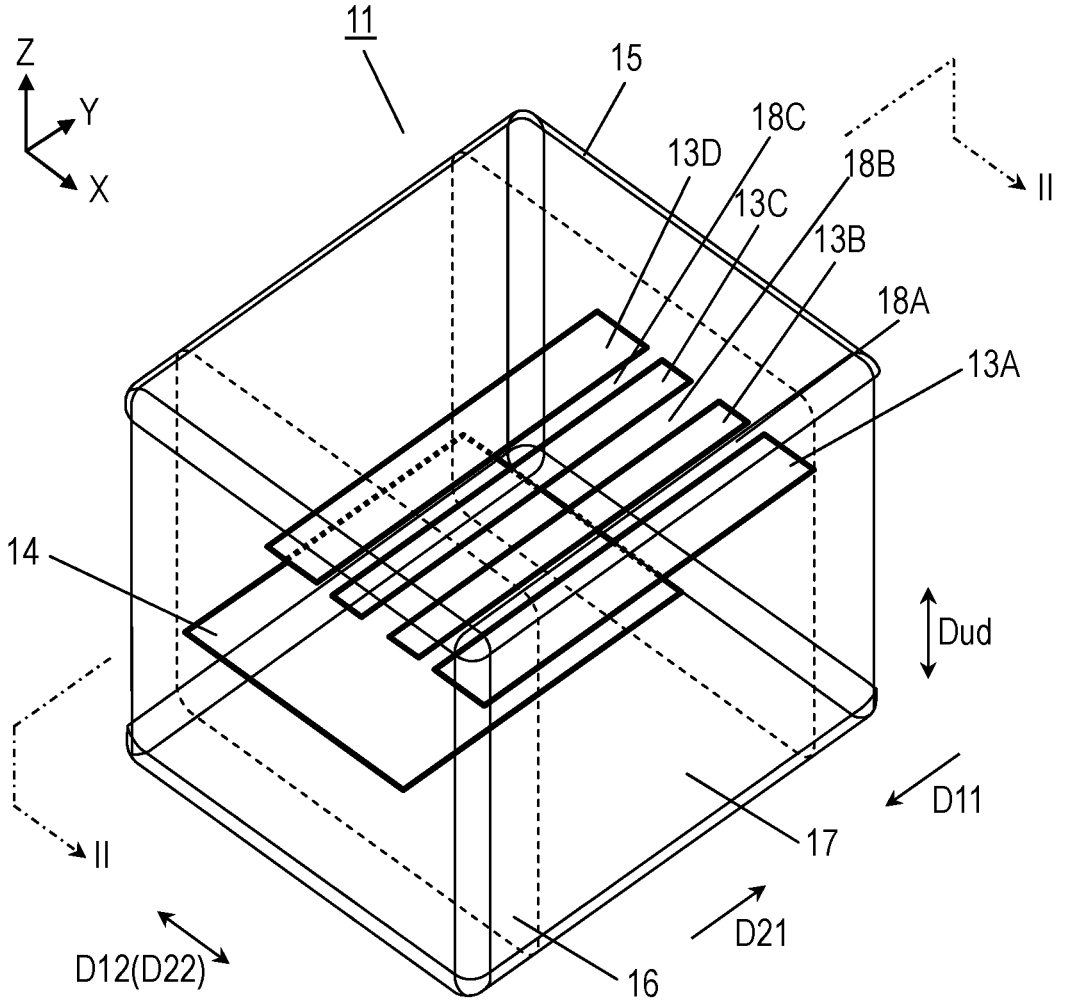
FIG. 1 is a transparent perspective view of a laminated varistor in accordance with an exemplary embodiment.
Figure 2:
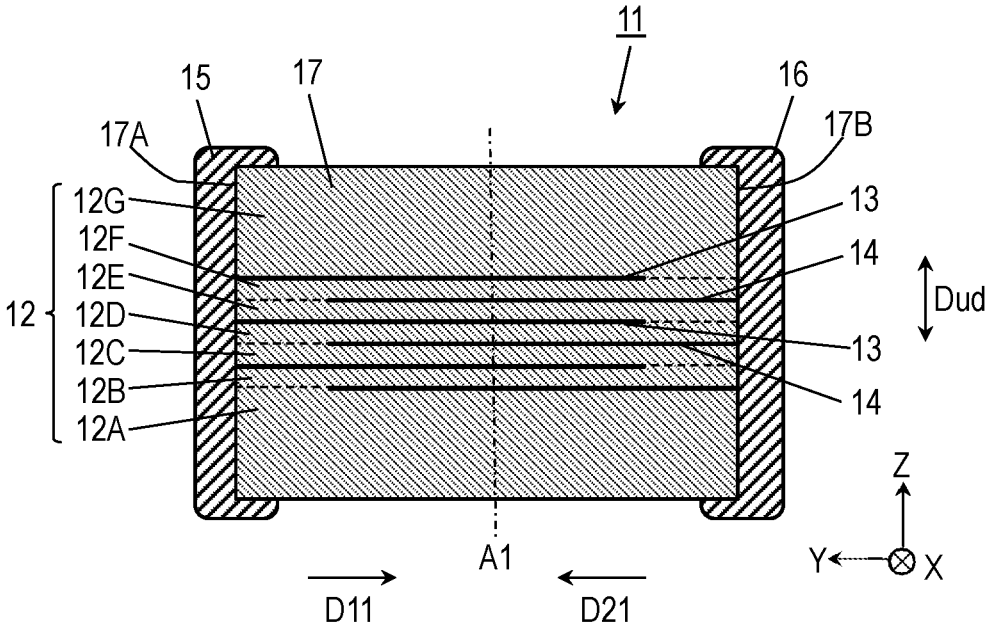
FIG. 2 is a cross-sectional view of the laminated varistor along line II-II shown in FIG. 1.

FIG. 1 is a transparent perspective view of laminated varistor 11 in accordance with an exemplary embodiment. FIG. 2 is a cross-sectional view of the laminated varistor taken along line II-II shown in FIG. 1. Laminated varistor 11 includes varistor layers 12A-12G made mainly of ZnO and internal electrodes 13 and 14 made mainly of Ag. Varistor layers 12A to 12G and internal electrodes 13 and 14 are stacked alternately on one another in upward and downward directions Dud, thus constituting laminated body 27. Varistor layers 12A-12G are laminated stacked upward and downward directions Dud. Internal electrodes 13 and 14 are drawn out alternately to both end surfaces of laminated body 27. Internal electrodes 13 and 14 are electrically connected to external electrodes 15 and 16 on the end surfaces, respectively. Laminated body 27 is sintered to form sintered body 17. The sintered body exists in a region between internal electrode 13 and internal electrode 14, and outside the region. The sintered body is mainly made of ZnO, and further contains additive, such as $Bi_2O_3$, $Co_2O_3$, $MnO_2$, or $Sb_2O_3$.

In a three-dimensional coordinate, a length in an X-direction is defined as a width, a length in a Y-direction is defined as a depth, and a length in a Z-direction is defined as a height. In the embodiment, sintered body 17 has a rectangular parallelepiped shape with a width of 5.0 mm, a depth of 5.7 mm, and a height of 5.0 mm. Upward and downward directions Dud are parallel to the Z-direction.

Figure 3:
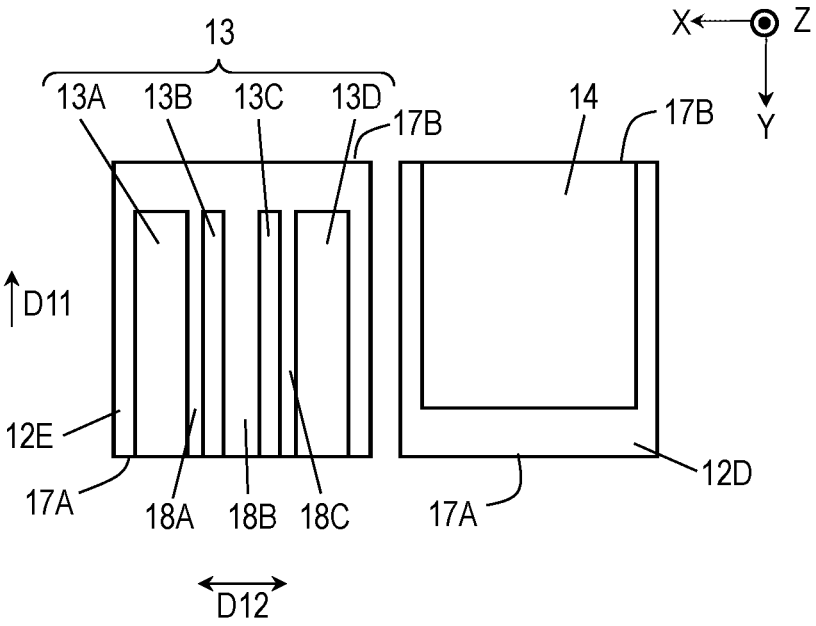
FIG. 3 is a plan view of an internal electrode of the laminated varistor in accordance with the embodiment.

FIG. 3 is a plan view of internal electrodes 13 and 14 when viewed in the Z-direction. In FIG. 3, internal electrode 13 is divided into four electrode strips 13A, 13B, 13C, and 13D.

Internal electrode 13 is provided on an upper surface of varistor layer 12B (12D, 12F). Internal electrode 14 is provided on a lower surface of varistor layer 12B (12D, 12F), and faces internal electrode 13 across varistor layer 12B (12D, 12F) in upward and downward directions Dud. External electrode 15 is provided on side surface 17A of the sintered body connected to the upper and lower surfaces of varistor layer 12B (12D, 12F), and is electrically connected to internal electrode 13. External electrode 16 is provided on side surface 17B of the sintered body connected to the upper and lower surfaces of varistor layer 12B (12D, 12F), and is electrically connected to internal electrode 14. Internal electrode 13 is extended from external electrode 15 in extension direction D11 parallel to the Y-direction. Internal electrode 13 includes electrode strips 13A-13D arranged in arrangement direction D12 perpendicular to extension direction D11 and parallel to the X-direction, and are spaced apart from one another in arrangement direction D12

Electrode strips 13A-13D are arranged in arrangement direction D12 and are spaced apart from one another with spaces 18A-18C in between. In detail, electrode strips 13A and 13B are arranged adjacent to each other in arrangement direction D12 while space 18A is provided between electrode strips 13A and 13B. Electrode strips 13B and 13C are arranged adjacent to each other in arrangement direction D12 while space 18B is provided between electrode strips 13B and 13C. Electrode strips 13C and 13D are arranged adjacent to each other in arrangement direction D12 while space 18C is provided between electrode strips 13C and 13D.

Varistor layers 12A-12G have rectangular shapes when viewed in upward and downward directions Dud. Side surface 17A and side surface 17B of varistor layer 12B (12A, 12C to 12G) which also serve as a side surface of sintered body 17 are located on sides of the rectangular shape that are opposite to each other.

The above structure allows heat generated in the varistor layer to be dispersed without decreasing the number of the varistor layers. This configuration prevents temperature of the element from rising locally when surge enters, thereby improving surge-resistant characteristics of the laminated varistor.

In the laminated varistor disclosed in PTL 1, an invalid layer which does not contribute to a varistor function is provided in the center of the laminated varistor. This configuration decreases the number of internal electrodes inside the laminated varistor. In other words, it means that an area of an effective layer which contributes to a varistor function is required to be reduced by the number of layers. As a result, it is made difficult to maximize surge resistance since the surge resistance depends on an area of the effective layer.

Laminated varistor 11 in accordance with the embodiment has improved surge-resistant characteristics, as mentioned above.

Each of electrode strips 13A and 13D has a rectangular shape with a width of 1.1 mm and a depth of 4.7 mm. Each of electrode strips 13B and 13C has a rectangular shape with a width of 0.5 mm and a depth of 4.7 mm. Electrode strip 13A is spaced from the side surface of sintered body 17 by an interval of 0.4 mm in the X-direction (a width direction). Electrode strips 13A and 13B are arranged in the X-direction while space 18A with a width of 0.3 mm is provided between the electrode strips 13A and 13B. Electrode strips 13C and 13D are arranged in the X-direction while space 18C with a width of 0.3 mm is provided between electrode strips 13C and 13D. Electrode strips 13B and 13C are arranged in the X-direction while space 18B with a width of 0.6 mm is provided between electrode strips 13B and 13C.

Internal electrode 14 has a rectangular shape with a width of 4.2 mm and a depth of 4.7 mm, and is spaced from internal electrode 13 by an interval of 0.2 mm in Z-direction. Internal electrode 13 divided into electrode strips 13A to 13D allows internal electrodes 13 and 14 to penetrate into varistor layers 12A-12G when pressurized in the laminating process of laminated body 27. This pressure enhances adhesion between the layers, providing an effect of preventing delamination. The number of the electrode strips obtained by dividing internal electrode 13 is preferably more than or equal to 4 and less than or equal to 16. The number of the electrode strips less than 4 may reduce the effect of preventing delamination. The number of the electrode strips more than 16 may decrease a total area of internal electrode 13, and deteriorating surge-resistant performance.

A length of spaces 18A-18C in the X-direction provided by dividing internal electrode 13 may be more than or equal to 0.2 mm. This configuration prevents current from flowing into the electrode strips adjacent to each other. Widths of spaces 18A to 18C in the X-direction are preferably less than or equal to ¼ of a width of laminated varistor 11 (varistor layers 12A-12G) in X-direction. Widths of spaces 18A to 18C in the in X-direction exceeding ¼ of a width of laminated varistor 11 (varistor layers 12A-12G) in the X-direction reduces a width of internal electrode 13 and may deteriorate the surge-resistant performance. Electrode strips 13A and 13D with large areas are arranged closer to a surface of sintered body 17 than electrode strips 13B and 13C with smaller areas than electrode strips 13A and 13D. This configuration allows heat generated when surge enters to be close to the surface of sintered body 17, so that the heat is easily dissipated to the outside. Thus, heat accumulation, which may cause a failure of the varistor, can be prevented.

Space 18B out of spaces 18A-18C which is located closer to a center of a row of spaces 18A-18C is preferably larger than space 18C out of spaces 18A-18C which is located closer to the side surface. This configuration prevents heat from accumulating inside sintered body 17, so that the surge resistance is improved more.

In accordance with the embodiment, a width of space 18B, in arrangement direction D12, located at a center of a row of spaces 18A-18C in arrangement direction D12 is larger than a width of any other space, e.g., space 18A (18C), in arrangement direction D12, among spaces 18A-18C.

In accordance with the embodiment, widths of electrode strips 13A-13D, in arrangement direction D12, located at both ends of a row of electrode strips 13A-13D in arrangement direction D12 are larger than a width of any other electrode strip, e.g., electrode strip 13B (13C), in arrangement direction D12, among electrode strips 13A-13D. The areas of electrode strips 13A and 13D located at both ends of a row of electrode strips 13A-13D in arrangement direction D12 are larger than an area of any other electrode strip, e.g., electrode strip 13B (13C) among electrode strips 13A-13D.

A width of entire internal electrode 13 in the X-direction is preferably smaller than a width of entire internal electrode 14 in the X-direction. This configuration may control positional misalignment between internal electrode 13 and internal electrode 14 facing each other, which occurs at the time of printing, lamination, and sintering. Thus, variation in electrical characteristics, such as electrostatic capacitance, determined by the area where internal electrodes 13 and 14 facing each other may be reduced.

Figure 4:
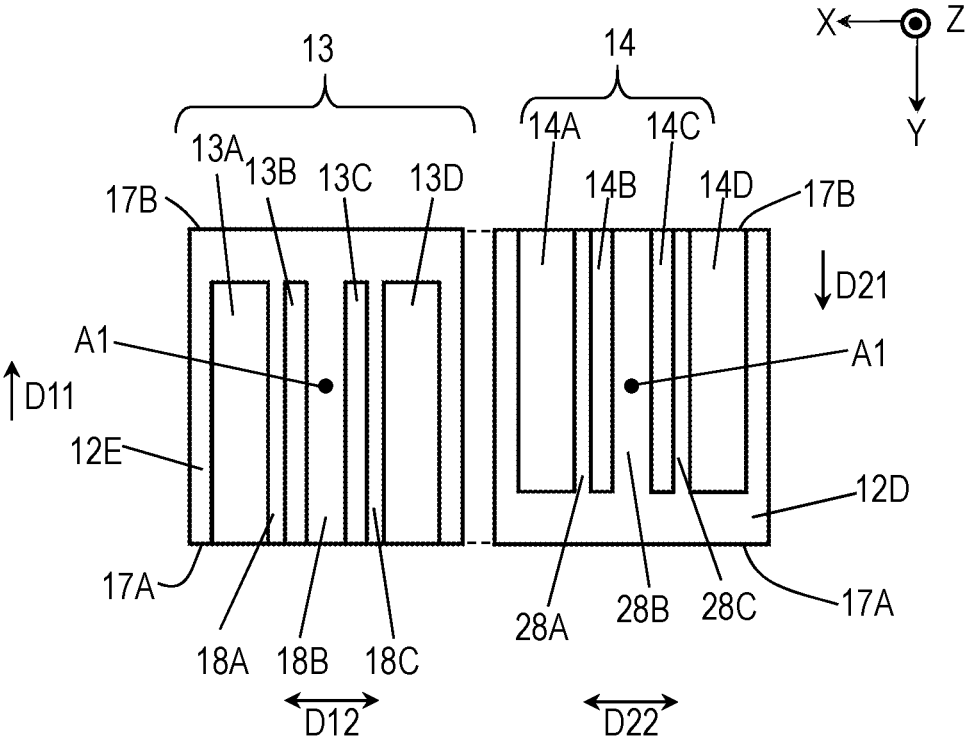
FIG. 4 is a plan view of an internal electrode of another laminated varistor in accordance with the embodiment.

FIG. 4 is a plan view of internal electrodes 13 and 14 of another laminated varistor 11 in accordance with the embodiment. In FIG. 4, components similar to those of internal electrodes 13 and 14 of laminated varistor 11 shown in FIG. 3 are denoted by the same reference numerals. Internal electrode 13 includes electrode strips 13A-13D spaced apart from one another in the X-direction, and internal electrode 14 includes electrode strips 14A-14D spaced apart from one another in the X-direction.

Internal electrode 14 is extended from external electrode 16 in extension direction D21 parallel to the Y-direction. Internal electrode 14 includes electrode strips 14A-14D arranged and spaced apart from one another in arrangement direction D22 perpendicular to extension direction D21 and parallel to X-direction. Electrode strips 14A-14D face electrode strips 13A-13D across varistor layer 12B in upward and downward directions Dud, respectively. Extension direction D21 is opposite to extension direction D11.

Electrode strips 14A-14D are arranged and spaced apart from one another in arrangement direction D22 while a corresponding one of spaces 28A-28C. In detail, electrode strips 14A and 14B are arranged adjacent to each other in arrangement direction D22 while space 28A is provided between electrode strips 14A and 14B. Electrode strips 14B and 14C are arranged adjacent to each other in arrangement direction D22 while space 28B is provided between electrode strips 14B and 14C. Electrode strips 14C and 14D are arranged adjacent to each other in arrangement direction D22 while space 28C is provided between electrode strips 14C and 14D. Spaces 28A-28C have the same size (length, width, area) as spaces 18A-18C, respectively.

In accordance with the embodiment, a width of space 28B, in arrangement direction D12, located at a center of a row of spaces 28A-28C is larger than a width of any other space, e.g., space 28A (28C), in arrangement direction D12, among spaces 28A-28C.

In accordance with the embodiment, widths of electrode strips 14A and 14D, in arrangement direction D22, located at both ends of a row of electrode strips 14A-14D are larger than a width of any other electrode strip, e.g., electrode strip 14B (14C), in arrangement direction D22, among electrode strips 14A-14D. The areas of electrode strips 14A and 14D located at both ends of a row of electrode strips 14A-14D in arrangement direction D22 are larger than the area of any other electrode strip, e.g., electrode strip 14B (14C) among electrode strips 14A to 14D.

Internal electrode 14 is placed in rotational symmetry with respect to internal electrode 13 about axis A1 which is extended in the Y-direction and which passes through the center of sintered body 17. Since not only internal electrode 13 but also internal electrode 14 includes electrode strips 14A-14D spaced apart from one another, a heat generation area when surge enters may be divided into more strips rather than the case where only internal electrode 13 is divided. This configuration prevents heat from accumulating.

Figure 5:
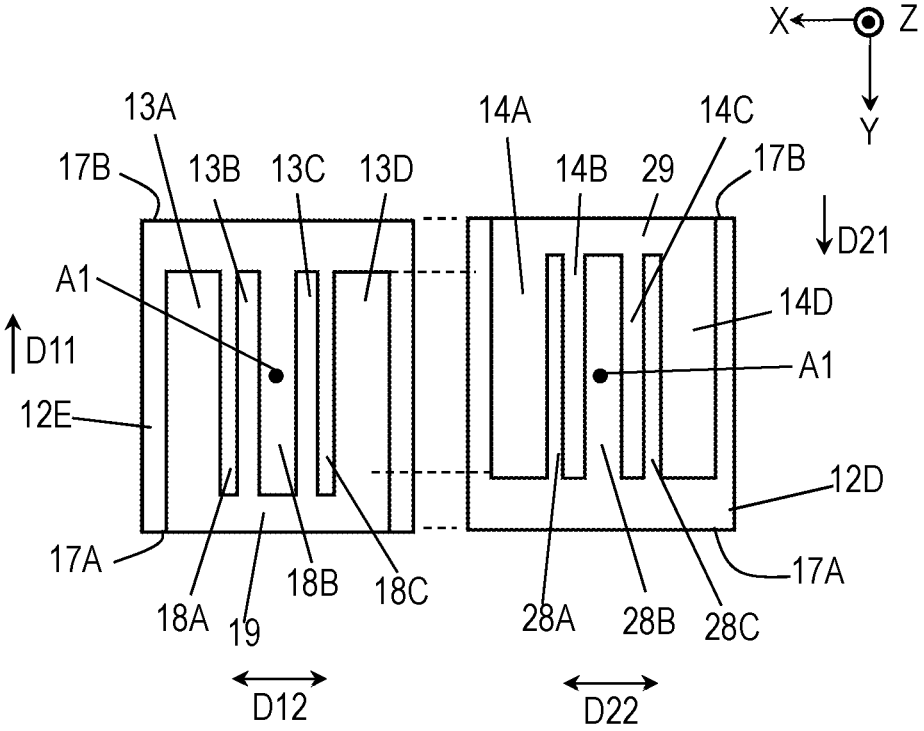
FIG. 5 is a plan view of an internal electrode of still another laminated varistor in accordance with the embodiment.

FIG. 5 is a plan view of internal electrodes 13 and 14 of still another laminated varistor 11 in accordance with the embodiment. In FIG. 5, components similar to those of internal electrodes 13 and 14 of laminated varistor 11 shown in FIG. 4 are denoted by the same reference numerals.

Internal electrode 13 further includes connection part 19 connected to external electrode 15. Electrode strips 13A-13D are extended from connection part 19 in extension direction D11, and are connected to external electrode 15 via connection part 19. Connection part 19 does not overlap internal electrode 14 when viewed in upward and downward directions Dud.

Internal electrode 14 further includes connection part 29 connected to external electrode 16. Electrode strips 14A-14D are extended from connection part 29 in extension direction D21, and are connected to external electrode 16 via connection part 29. Connection part 29 does not overlap internal electrode 13 when viewed in upward and downward directions Dud.

A depth of connection part 19, which is a length of connection part 19 in extension direction D11 is 0.5 mm. A depth of connection part 29, which is a length of connection part 29 in extension direction D21 is 0.5 mm. This configuration increase a length of a part where internal electrode 13 is connected to external electrode 15 and a length of a part where internal electrode 14 is connected to external electrode 16, thereby preventing occurrence of poor connection between internal electrodes 13 and 14 and external electrodes 15 and 16 when external electrodes 15 and 16 are formed.

Figure 6:
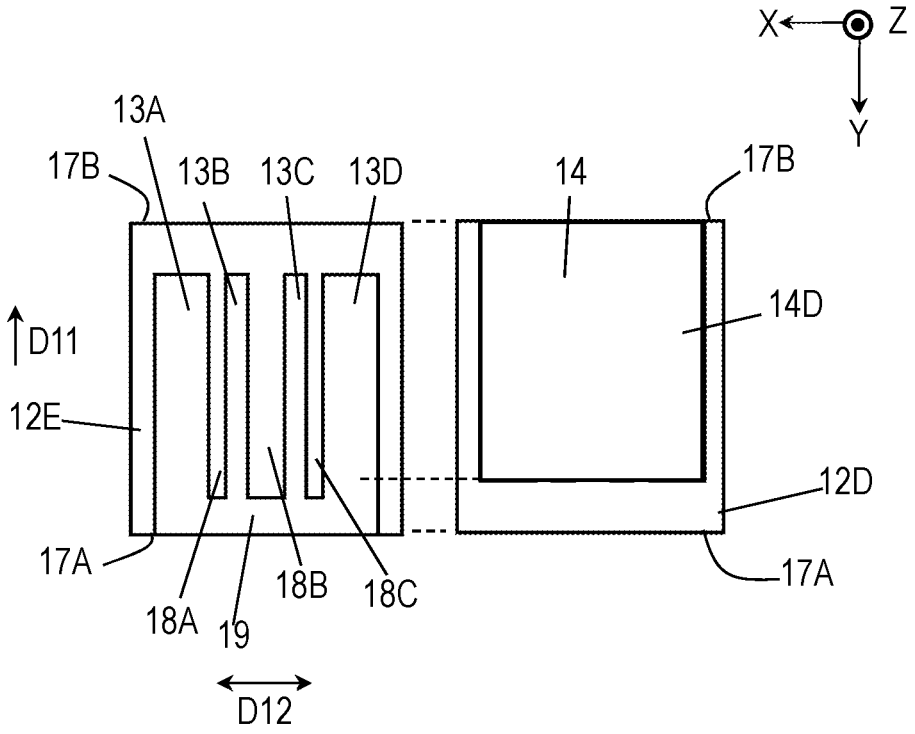
FIG. 6 is a plan view of an internal electrode of a further laminated varistor in accordance with the embodiment.

FIG. 6 is a plan view of internal electrodes 13 and 14 of further laminated varistor 11 in accordance with the embodiment. In FIG. 6, components similar to those of internal electrodes 13 and 14 of laminated varistor 11 shown in FIGS. 3 and 5 are denoted by the same reference numerals. The laminated varistor shown in FIG. 6 includes internal electrode 13 including connection part 19 shown in FIG. 5, and internal electrode 14 shown in FIG. 3. Connection part 19 shown in FIG. 6 has the same effect as connection part 19 shown in FIG. 5.

In the embodiment, term, such as "upper surface," "lower surface," and "upward and downward directions," indicating directions indicate relative directions determined only by spatial relationship between component members, such as varistor layers and internal electrodes 13 and 14, of laminated varistor 11, but should not be construed to indicate absolute directions, such as a vertical direction.

Laminated varistors 11 in accordance with the embodiment shown in FIGS. 1-6 prevents heat from accumulating between internal electrodes 13 and 14 without reducing the number of the varistor layers between internal electrodes 13 and 14 facing each other. This configuration improves surge resistance and energy resistance of laminated varistor 11.

REFERENCE MARKS IN THE DRAWINGS

11 laminated varistor
12A-12G varistor layer
13 internal electrode (first internal electrode)
13A-13D electrode strip (first electrode strip)
14 internal electrode (second internal electrode)
15 external electrode (first external electrode)
16 external electrode (second external electrode)
17 sintered body
18A-18C space
19 connection part
14A-14D electrode strip (second electrode strip)
28A-28C space
29 connection part
D11 extension direction (first extension direction)
D12 extension direction (second extension direction)
D21 arrangement direction (first arrangement direction)
D22 arrangement direction (second arrangement direction)
Dud upward and downward directions

The invention claimed is:

1. A laminated varistor comprising:

a varistor layer;

a first internal electrode provided on an upper surface of the varistor layer;

a second internal electrode provided on a lower surface of the varistor layer, the second internal electrode facing the first internal electrode across the varistor layer in upward and downward directions;

a first external electrode provided on a first side surface of the varistor layer, the first side surface of the varistor layer being connected to the upper surface and the lower surface of the varistor layer, the external electrode being electrically connected to the first internal electrode; and a second external electrode provided on a second side surface of the varistor layer, the second side surface of the varistor layer being connected to the upper surface and the lower surface of the varistor layer, electrically connected to the second internal electrode, wherein:

the first internal electrode is extended from the first external electrode in a first extension direction, the first internal electrode includes a plurality of first electrode strips arranged in a first arrangement direction perpendicular to the first extension direction, the plurality of first electrode strips being spaced apart from one another, a number of the plurality of first electrode strips is more than or equal to 4 and less than or equal to 16, the plurality of first electrode strips are arranged in the first arrangement direction and spaced apart from one another with a plurality of spaces in between, each of the plurality of spaces is provided between a corresponding pair of adjacent first electrode strips of the plurality of first electrode strips, and a width of a space, in the first arrangement direction, out of the plurality of spaces which is located at a center of a row of the plurality of spaces is larger than a width of any other space, in the first arrangement direction, among the plurality of spaces.

2. The laminated varistor according to claim 1, wherein widths of the plurality of spaces in the first arrangement direction are more than or equal to 0.2 mm and less than or equal to ¼ of a width of the varistor layer in the first arrangement direction.

3. The laminated varistor according to claim 1, wherein widths of first electrode strips, in the first arrangement direction, out of the plurality of first electrode strips located at both ends of a row of the plurality of first electrode strips are larger than a width of any other first electrode strip, in the first arrangement direction, among the plurality of first electrode strips.

4. The laminated varistor according to claim 1, wherein areas of first electrode strips of the plurality of first electrode strips located at both ends of a row of the plurality of first electrode strips in the first arrangement direction are larger than an area of any other first electrode strip of the plurality of first electrode strips.

5. The laminated varistor according to claim 1, wherein the first internal electrode further includes a first connection part connected to the first external electrode, the plurality of first electrode strips are extended from the first connection part in the first extension direction and are connected to the first external electrode via the first connection part, and the first connection part does not overlap the second internal electrode when viewed in the upward and downward directions.

6. The laminated varistor according to claim 1, wherein the second internal electrode are extended from the second external electrode in a second extension direction, and the second internal electrode includes a plurality of second electrode strips arranged in a second arrangement direction perpendicular to the second extension direction and spaced apart from one another in the second arrangement direction.

7. The laminated varistor according to claim 6, wherein each of the plurality of second electrode strips faces a corresponding one of the plurality of first electrode strips in the upward and downward directions across the varistor layer.

8. The laminated varistor according to claim 6, wherein the first internal electrode further includes a first connection part connected to the first external electrode, the plurality of first electrode strips are extended from the first connection part in the first extension direction and are connected to the first external electrode via the first connection part, and the first connection part does not overlap the second internal electrode when viewed in the upward and downward directions.

9. The laminated varistor according to claim 6, wherein the second internal electrode further includes a second connection part connected to the second external electrode, the plurality of second electrode strips are extended from the second connection part in the second extension direction, and are connected to the second external electrode via the second connection part, and the second connection part does not overlap the first internal electrode when viewed in the upward and downward directions.

10. The laminated varistor according to claim 6, wherein the second extension direction is opposite to the first extension direction.

11. The laminated varistor according to claim 1, wherein the varistor layer has a rectangular shape when viewed in the upward and downward directions, and each of the first side surface and the second side surface of the varistor layer is located on a corresponding one of sides of the rectangular shape opposite to each other.

12. A laminated varistor, comprising:

a varistor layer;

a first internal electrode provided on an upper surface of the varistor layer;

a second internal electrode provided on a lower surface of the varistor layer, the second internal electrode facing the first internal electrode across the varistor layer in upward and downward directions;

a first external electrode provided on a first side surface of the varistor layer, the first side surface of the varistor layer being connected to the upper surface and the lower surface of the varistor layer, the external electrode being electrically connected to the first internal electrode; and a second external electrode provided on a second side surface of the varistor layer, the second side surface of the varistor layer being connected to the upper surface and the lower surface of the varistor layer, electrically connected to the second internal electrode, wherein:

the first internal electrode is extended from the first external electrode in a first extension direction, the first internal electrode includes a plurality of first electrode strips arranged in a first arrangement direction perpendicular to the first extension direction, the plurality of first electrode strips being spaced apart from one another, a number of the plurality of first electrode strips is more than or equal to 4 and less than or equal to 16, the plurality of first electrode strips are arranged in the first arrangement direction and spaced apart from one another with a plurality of spaces in between, each of the plurality of spaces is provided between a corresponding pair of adjacent first electrode strips of the plurality of first electrode strips, and widths of the plurality of spaces in the first arrangement direction are more than or equal to 0.2 mm and less than or equal to ¼ of a width of the varistor layer in the first arrangement direction.

13. A laminated varistor, comprising:

a varistor layer;

a first internal electrode provided on an upper surface of the varistor layer;

a second internal electrode provided on a lower surface of the varistor layer, the second internal electrode facing the first internal electrode across the varistor layer in upward and downward directions;

a first external electrode provided on a first side surface of the varistor layer, the first side surface of the varistor layer being connected to the upper surface and the lower surface of the varistor layer, the external electrode being electrically connected to the first internal electrode; and a second external electrode provided on a second side surface of the varistor layer, the second side surface of the varistor layer being connected to the upper surface and the lower surface of the varistor layer, electrically connected to the second internal electrode, wherein:

the first internal electrode is extended from the first external electrode in a first extension direction, the first internal electrode includes a plurality of first electrode strips arranged in a first arrangement direction perpendicular to the first extension direction, the plurality of first electrode strips being spaced apart from one another, the second internal electrode are extended from the second external electrode in a second extension direction, the second internal electrode includes a plurality of second electrode strips arranged in a second arrangement direction perpendicular to the second extension direction and spaced apart from one another in the second arrangement direction, and intervals between the plurality of first electrode strips in the first arrangement direction are more than or equal to 0.2 mm and less than or equal to ¼ of a width of the varistor layer in the first arrangement direction.

* * * * *